US008833960B2

(12) United States Patent
Opolka

(10) Patent No.: US 8,833,960 B2
(45) Date of Patent: Sep. 16, 2014

(54) WATERPROOF TORCH

(75) Inventor: Rainer Opolka, Solingen (DE)

(73) Assignee: Zweibrueder Optoelectronics GmbH & Co. KG, Solingen (DE)

( * ) Notice: Subject to any disclaimer, the term of this patent is extended or adjusted under 35 U.S.C. 154(b) by 0 days.

(21) Appl. No.: 13/704,494

(22) PCT Filed: Jun. 20, 2011

(86) PCT No.: PCT/DE2011/001313

§ 371 (c)(1),
(2), (4) Date: Dec. 14, 2012

(87) PCT Pub. No.: WO2012/010126

PCT Pub. Date: Jan. 26, 2012

(65) Prior Publication Data

US 2013/0107504 A1 May 2, 2013

(30) Foreign Application Priority Data

Jul. 21, 2010 (DE) ..... 10 2010 031 816

(51) Int. Cl.

| | |
|---|---|
| ***F21L 4/00*** | (2006.01) |
| ***F21V 31/00*** | (2006.01) |
| ***F21V 23/04*** | (2006.01) |

(52) U.S. Cl.

CPC ..... *F21V 31/005* (2013.01); *F21L 4/005* (2013.01); *F21L 4/00* (2013.01); *F21V 23/0421* (2013.01)

USPC ..... 362/158; 362/202

(58) Field of Classification Search

USPC ..... 362/158, 202

See application file for complete search history.

(56) References Cited

U.S. PATENT DOCUMENTS

| | | | | |
|---|---|---|---|---|
| 3,798,440 | A | 3/1974 | Brindley | |
| 7,083,300 | B2 | 8/2006 | Sharrah | |
| 7,971,301 | B2 | 7/2011 | Park | |
| 2004/0057233 | A1 * | 3/2004 | Sharrah et al. | 362/205 |
| 2009/0016050 | A1 * | 1/2009 | Opolka | 362/206 |
| 2009/0129069 | A1 * | 5/2009 | Grossman | 362/189 |
| 2009/0184646 | A1 | 7/2009 | Devaney | |

* cited by examiner

*Primary Examiner* — Evan Dzierzynski
(74) *Attorney, Agent, or Firm* — Andrew Wilford

(57) ABSTRACT

The present invention relates to a flashlight having a housing, a battery cartridge which is mounted therein and has a pressure switch at the end, and an end cap having a pushbutton which is operatively connected to the pressure switch. In order to create a watertight and simultaneously robust flashlight, it is proposed according to the invention that a sealing element be arranged between the pushbutton and the pressure switch.

11 Claims, 1 Drawing Sheet

WATERPROOF TORCH

CROSS REFERENCE TO RELATED APPLICATIONS

This application is the US-national stage of PCT application PCT/DE2011/001313 filed 20 Jun. 2011 and claiming the priority of German patent application 102010031816.7 itself filed 21 Jul. 2010.

FIELD OF THE INVENTION

The present invention relates to a flashlight having a housing, a battery cartridge mounted therein and having a push switch at the end, and an end cap having a pushbutton which is operatively connected to the push switch.

BACKGROUND OF THE INVENTION

Flashlights of the type described above are known from the prior art. For example, DE 10 1007 032 003 describes such a flashlight that switch is disadvantageously not formed in a watertight manner.

DE 24 13 016 [U.S. Pat. No. 3,798,440] discloses a watertight flashlight that switch has a push switch arranged in the housing. The push switch has a rubber switch cover, and an additional sealing ring is arranged between the switch cover and the housing. In order to actuate the push switch, the elastic switch cover has to be pushed merely downward.

Watertight flashlights are frequently used outdoors where the requirements for a robust configuration of the flashlight are high, since the material is highly stressed not only while the flashlight is being used as intended, but also while it is being transported in backpacks or in panniers. In this case, in particular the housing is exposed to high loads, and so the soft and low-resistance switch cover also wears out relatively quickly and has to be replaced.

OBJECT OF THE INVENTION

It is therefore the object of the present invention to remedy this and to provide a watertight and simultaneously robust flashlight.

SUMMARY OF THE INVENTION

This object is achieved by the flashlight according to the invention in that a sealing element is provided between the pushbutton and the push switch. As a result, the complete housing, including the pushbutton, consists of a robust material and the switch is formed preferably in a scratch- and impact-resistant manner. According to one embodiment of the invention, the housing consists of an optionally coated light metal, such as aluminum, for example, or plastic. Nevertheless, the flashlight according to the invention is watertight, with the sealing element being arranged such that it cannot be damaged by other objects and accordingly has to be replaced comparatively rarely.

Preferred embodiments of the present invention are specified in the following text and in the claims.

According to a first configuration, the pushbutton has a head part projecting out of the end cap, a guide part mounted in the end cap and an actuating part. The guide part is formed such that the pushbutton is longitudinally axially movable within the end cap, with a rear stop surface preventing the pushbutton from falling out of the end cap. The actuating part is preferably cylindrical and connected indirectly to the push switch, with the sealing element arranged between the actuating part and the push switch. The sealing element is preferably a cap made of an elastic material and having an annular clamping surface and a raised part projecting therefrom. Suitable materials for the sealing element are in particular rubber or some other elastomer, such as polyurethane or PVC, for example. In the assembled state, the push switch is beneath the raised part of the cap, so that the push switch can be actuated indirectly by the pushbutton.

According to a preferred embodiment, it is provided that in the raised part of the cap there is a blind depression into which the actuating part engages. As a result, the sealing element is connected at least so firmly to the pushbutton or the end cap that the sealing element cannot fall off and be lost if the end cap is removed from the housing for example in order to change the batteries. Alternatively thereto, the sealing element can also be clamped in an annular groove within the end cap. In this case, the end cap has an internal thread and an external thread, so that the end cap is connected both to the battery cartridge and to the housing via complementary threaded portions. A threaded connection can be produced easily and also forms a robust connection. Furthermore, the watertight connection can be created via a threaded connection, since the sealing element is preferably clamped by the annular clamping surface between two annular stop surfaces of the end cap and the battery cartridge. The more firmly the threaded connection is closed, the tighter the connection.

BRIEF DESCRIPTION OF THE DRAWING

Further preferred configurations and specific embodiments are explained in the following text with reference to the drawings, in which.

SPECIFIC DESCRIPTION OF THE INVENTION

Figure 1:
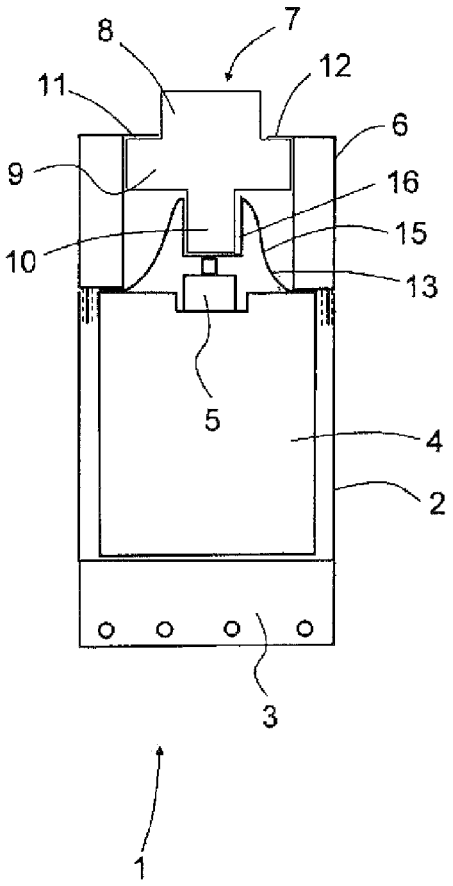
FIG. 1 is a cross-sectional view of a flashlight in the assembled state.
Figure 2:
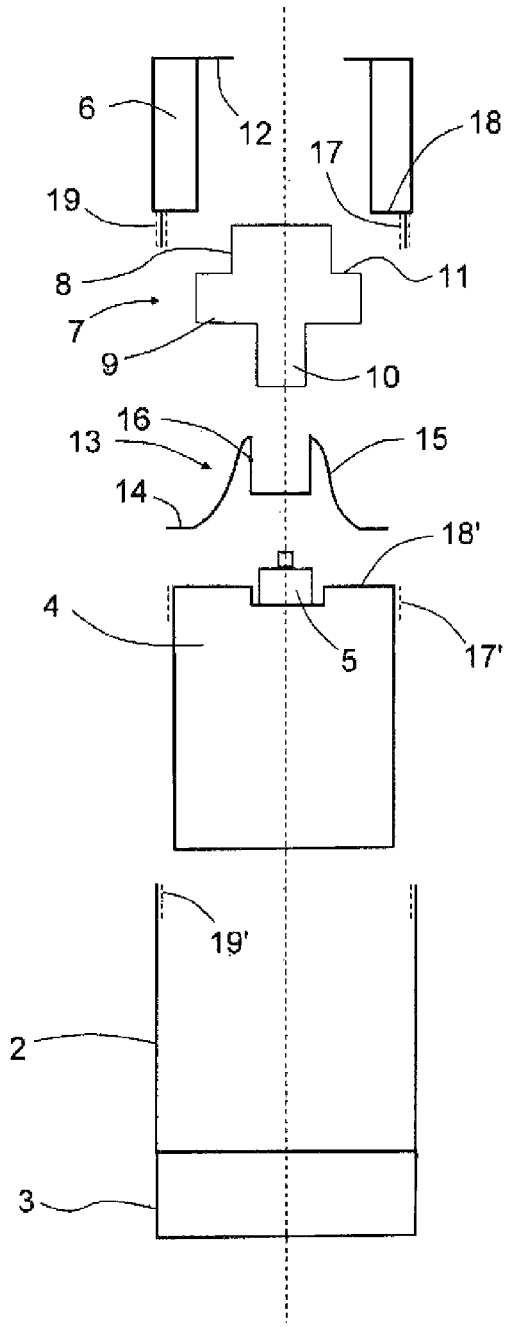
FIG. 2 is an exploded illustration of a flashlight.

The flashlight 1 consists substantially of a housing 2 having a lamp head 3, a battery cartridge 4 having a push switch 5 arranged at the end, and an end cap 6 having a pushbutton 7 that is axially longitudinally movable therein. The pushbutton has a head part 8, a guide part 9 and an actuating part 10. In order that the pushbutton 7 cannot fall out of the end cap 6 in the assembled state, an annular stop surface 11 is formed on the guide part 9, the stop surface 11 engaging an also annular stop surface 12 in the end cap 6. In order to prevent water from entering into the interior of the housing 2, a sealing element 13 is provided between the pushbutton 7 and the push switch 5. The sealing element 13 is preferably rotationally symmetrical and has an annular clamping surface 14 and an raised part 15 in which there is formed a blind depression 16. The actuating part 10 engages in the depression 16. In order to connect the battery cartridge to the end cap, there are complementary threaded portions 17, 17'. Furthermore, annular stop surfaces 18, 18' are provided on the battery cartridge 4 and on the end cap 6, it being possible to clamp the sealing element 13 firmly between the annular stop surfaces 18, 18' by the annular clamping surface 14. Finally, corresponding threaded portions 19, 19' are formed on the end cap 6 and on the housing 2. In order to form the flashlight in a watertight manner overall, this threaded connection can also be sealed off by a seal (not illustrated).

The invention claimed is:

1. A flashlight comprising:

a housing having a rear end;

a removable end cap on the rear end of the housing;

a light source on the housing;

a battery cartridge in the housing carrying a push switch actuatable to connect a battery in the cartridge to the light source;

to a pushbutton shiftable on the end cap and having an actuating part; and a seal membrane made of elastomeric material and having an annular clamping surface sealed to the housing and a raised part surrounded by the clamping surface and engageable with the actuating part, the membrane extending between the pushbutton and the switch and sealing the battery cartridge off from the rear end of the housing such that water entering around the pushbutton cannot get to the battery cartridge.

2. The flashlight as claimed in claim 1, wherein the pushbutton has a head part protruding out of the end cap, a guide part mounted in the end cap and an actuating part.

3. The flashlight as claimed in claim 1, wherein the raised part of the cap there is formed with a blind depression into which the actuating part engages.

4. The flashlight as claimed in claim 1, wherein the end cap has an internal thread and an external thread, so that the end cap is connected both to the battery cartridge and to the housing via corresponding threaded portions.

5. A flashlight comprising:

a housing having a rear end;

a removable end cap on the rear end of the housing;

a light source on the housing;

a battery cartridge in the housing carrying a push switch actuatable to connect a battery in the cartridge to the light source;

a pushbutton shiftable on the end cap; and a seal membrane secured to the housing, extending between the pushbutton and the switch, and sealing the battery off from the rear end of the housing such that water entering around the pushbutton cannot get to the battery cartridge, the seal element being clamped by way of the annular clamping surface between two annular stop surfaces of the end cap and the battery cartridge.

6. A flashlight comprising:

a housing centered on an axis having a rear end;

a removable end cap on the rear end of the housing;

a light source on the housing;

a battery cartridge in the housing carrying a push switch actuatable to connect a battery in the cartridge to the light source;

a pushbutton shiftable on the end cap; and a seal membrane secured to the housing, extending between the pushbutton and the switch, and having a circular outer periphery lying in a plane and clamped between the end cap and the housing to seal the battery off from the rear end of the housing such that water entering around the pushbutton cannot get to the battery cartridge, the membrane having a center part offset axially rearward from the outer periphery and engaged axially between the pushbutton and the switch.

7. A flashlight comprising:

a housing having a rear end;

a removable end cap on the rear end of the housing;

a light source on the housing;

a battery cartridge in the housing carrying a push switch actuatable to connect a battery in the cartridge to the light to source;

a pushbutton shiftable on the end cap; and a membrane sealed to the housing, extending between, engageable with, and separate from the pushbutton and the switch, and sealing the battery off from the rear end of the housing such that water entering around the pushbutton cannot get to the battery cartridge.

8. The flashlight defined in claim 7, wherein the membrane is flexible and has a circular outer periphery lying in a plane and clamped between the end cap and the housing.

9. The flashlight defined in claim 8, wherein the housing is centered on an axis and the membrane has a center part offset axially rearward from the outer periphery and engaged axially between the pushbutton and the switch.

10. The flashlight defined in claim 9, wherein the pushbutton has an axially forwardly extending projection and the membrane has an axially rearwardly open cup-shaped seat complementarily receiving the projection.

11. The flashlight defined in claim 10, wherein the projection and seat are both of cylindrical shape and centered on the axis.

* * * * *